US005432975A

United States Patent [19]

Hilmanowski

[11] Patent Number: 5,432,975

[45] Date of Patent: Jul. 18, 1995

[54] SELF-CONTAINED CONTINUOUS FLOW RECYCLING APPARATUS

[75] Inventor: James R. Hilmanowski, St. Paul, Minn.

[73] Assignee: CFR Corporation, New Brighton, Minn.

[21] Appl. No.: 148,588

[22] Filed: Nov. 4, 1993

[51] Int. Cl.[6] ..... A47L 11/30

[52] U.S. Cl. ..... 15/320; 15/321; 15/354

[58] Field of Search ..... 15/320, 321, 354

[56] References Cited

U.S. PATENT DOCUMENTS

| | | | |
|---|---|---|---|
| 3,402,420 | 9/1968 | Schaeffer | 15/320 |
| 3,879,789 | 4/1975 | Kasper | 15/320 X |
| 4,069,540 | 1/1978 | Zamboni | 15/320 |
| 4,483,041 | 11/1984 | Waldhauser et al. | 15/320 X |
| 4,709,442 | 12/1987 | Sletten | 15/320 |
| 4,809,397 | 3/1989 | Jacobs et al. | 15/320 |
| 4,953,254 | 9/1990 | Kohl et al. | 15/320 |

*Primary Examiner*—Christopher K. Moore
*Attorney, Agent, or Firm*—Frederick W. Niebuhr; Haugen and Nikolai

[57] ABSTRACT

A portable, compact and self-contained continuous flow recycling system includes a housing to accommodate a vacuum motor and liquid pump for recirculating a liquid cleaning solution and air. A pair of wheels supports the housing for tilting about a wheel axle. A pair of support arms are mounted to rotate on the axle, and their opposite ends are fixed to the shell of a cleaning head. The head is shaped to define a first compartment for receiving atomized cleaning solution and air, and a second compartment. A vacuum source draws the solution and air from the first chamber, across a partition near the floor, into the second compartment. The head is free to travel in an arcuate path relative to the housing, with its orientation determined by the arms, to insure a desired coplanarity with the floor or other surface being cleaned, when the head is in its operating position. A latching mechanism can secure the cleaning head in an upright position, away from the floor, sufficiently to accommodate a tilting of the housing to an upright position in which a bottom of the housing (rather than the wheels) supports the device. A pair of pivot links, associated with each arm, limits pivoting of the arm beyond a certain location below the operating position. The pivot arms, in cooperation with a glide formed as part of the shell, precisely position and orient the cleaning head for maximum efficiency.

20 Claims, 6 Drawing Sheets

SELF-CONTAINED CONTINUOUS FLOW RECYCLING APPARATUS

BACKGROUND OF THE INVENTION

The present invention relates to continuous flow recycling systems for cleaning carpeted floors and other substantially planar surfaces, and more particularly to a portable, upright and self-contained continuous-flow recycling device.

Continuous-flow recycling has gained widespread acceptance as a particularly effective technique for cleaning carpets, upholstery, fabric, wall coverings and hard surfaces such as ceramics. According to this technique, a liquid cleaning solution is sprayed toward the carpet or other surface being cleaned. A vacuum source creates a high velocity air stream that draws the atomized liquid toward and into the carpet. Almost immediately, however, the air stream is diverted to draw the liquid upwardly out of the carpet and at the same time extract soil, debris and other foreign matter to clean the carpet. The rapid and abrupt change in direction promotes efficient recovery of most of the cleaning solution, prevents undesirable soaking of the carpet backing, and substantially reduces drying time.

Continuous-flow recycling systems typically include a tank of liquid cleaning solution supported on a wheel-mounted base or framework. A motor and liquid pump for circulating the cleaning solution and a vacuum motor and pump for recovering the solution and returning the solution to the tank, also are mounted on the framework. The cleaning head is not integral with the framework, but rather is coupled to the solution tank through pliable hosing and thus is movable independently. Frequently the connection includes a wand or other length of rigid tubing to enable the operator to orient the head or other cleaning tool by handling the wand.

This arrangement requires considerable lengths of pliable hosing for supplying the cleaning solution to the head or other cleaning tool and for recovering the atomized solution (immediately after cleaning) and returning the solution to the tank by a vacuum. If desired, the liquid supply hose can be contained within the vacuum return hosing and wand. See for example U.S. Pat. No. 4,466,155 (Grave). Patents describing the cleaning heads or tools used in these systems include U.S. Pat. Nos. 4,649,594 and 4,720,889, both issued to Grave.

The use of independent cleaning heads or other tools affords several advantages, the most prominent being the ease in manipulating the tool without having to move the tank or canister. The tool is readily applied to non-horizontal surfaces, e.g. to clean walls or upholstered furniture.

The independent wand/tool arrangement also gives rise to difficulties, however. One of these is the excessive lengths of tubing between the canister and head. This reduces efficiencies in the supply of liquid to the area to be cleaned, and in the vacuum recovery of the liquid. The canister, pump and motor assembly is cumbersome to handle and store. Also, since the wand and cleaning tool are entirely subject to operator control, proper orientation of the tool for optimal cleaning depends upon the skill of the operator.

Therefore, it is an object of the present invention to provide a portable, self-contained vacuum operated cleaning apparatus in which a cleaning head or other tool is mounted to the housing of the device in a manner that better insures correct orientation of the cleaning tool during use of the device.

Another object is to provide a compact, lightweight, self-contained cleaning device that is easier to use and requires less storage space than a comparable system employing a canister and independent cleaning tool.

A further object is to provide a vacuum cleaning system employing a recycled liquid cleaning solution, in which the vacuum and cleaning solution paths between a solution tank and cleaning tool are shortened to minimize losses in efficiency.

Yet another object is to provide a means to positively support a cleaning head or other cleaning tool with respect to a wheel-supported housing, which aligns the tool yet provides limited freedom for tool rotation about two perpendicular axes parallel to the surface being cleaned, while cooperating with a vacuum source to control the tool position and orientation relative to the surface being cleaned.

SUMMARY OF THE INVENTION

To achieve these and other objects, there is provided a portable vacuum cleaning apparatus. The apparatus includes a housing, and a wheel means mounted to the housing for rotation on a wheel axis. The wheel means supports the housing for movement over a substantially planar surface. A vacuum head of the apparatus includes a shell having top wall means and a side wall means, with the side wall means including a lower edge means for engaging the surface to be cleaned, whereby the shell and surface cooperate to define a substantially enclosed chamber. A substantially rigid head support means is mounted to pivot relative to the housing, thus to support the head for movement in an arcuate path relative to the housing. The arcuate path includes an operating position in which the lower edge means engage the surface, and a raised position in which the shell is held above and spaced apart from the surface. The shell is fixed to the head support means in a predetermined orientation to insure substantial coplanarity of the lower edge means and the surface when the shell is in the operating position. A vacuum means draws a partial vacuum within the chamber when the shell is in the operating position. The vacuum means includes a vacuum source in the housing and a vacuum conduit means extending from the housing to the shell in fluid communication with the vacuum source and with the chamber. The vacuum conduit means is pliable to accommodate the arcuate travel of the head assembly.

The head support means can pivot on a pivot axis that is parallel to the wheel axis. More preferably, the pivot axis and the wheel axis coincide, so that the housing can be tipped or rotated on the wheel axis without changing the position of the pivot axis. This insures maintenance of the correct tool position and orientation during operation, regardless of any variance in housing tilt, e.g. due to different heights of individuals using the apparatus, or a given individual changing the housing tilt angle from time to time to avoid undue fatigue.

The preferred support means includes two support arms, one on each side of the housing. One end of each arm pivots relative to the housing, while the other end of each arm is fixed to the shell. The shell advantageously is elongate in the direction parallel to the wheel axis and pivot axis, and has a head width dimension parallel to the surface when in the operating position. The length dimension of each support arm is substantially parallel to the head width dimension and at least five times the head width dimension. Consequently, minor deviations from surface planarity (for example a slight rise in a horizontal floor) pivot the support arms, but only over a slight angle such that the head orientation remains essentially constant. The support arm pivoting in this instance can be thought of as a pivot axis adjustment.

The support means also can include a roll axis adjustment, i.e. by permitting limited rotation about a roll axis parallel to the floor and perpendicular to the pivot axis. More particularly, the pivot mounting of each arm includes a bushing on an axle of the wheels with the interior diameter of each bushing being slightly larger than the outer diameter of the wheel axle.

A latch can be provided for maintaining the head assembly in the raised position. Further, the housing can be selectively configured to include a flat bottom surface to accommodate tilting of the housing to a free-standing position in which the bottom surface supports the weight of the housing and maintains the wheels and the latched head assembly above the surface. The free-standing position requires minimum storage space, and is convenient other in times when the device is left unattended. Further, it is advantageous to provide pairs of elongate links pivotally connected between the housing and the head support arms. The links act as a stop means for limiting arcuate travel of the head assembly away from the raised position, to a predetermined suspended position beyond the operating position. This avoids an undesirable free swinging of the head assembly relative to the housing, but also facilitates transporting of the device without the need to latch the head assembly into the raised position. Further, whenever the device is left unattended for brief periods, there is no need to latch the head assembly. This is due in part to the links, which permit the head assembly to rest upon the surface even though the housing is tilted backwardly. Further, the heavier components of the system, i.e. the pumps and motors, are selectively located in the housing to position the device center of mass between the wheels and the head assembly, while also maintaining a low mass center.

The preferred shell includes a forward wall, a rearward wall and a partition between the forward and rearward walls that divides the chamber into a first compartment for receiving a spray of the cleaning liquid and a second compartment in fluid communication with the vacuum source. The partition has a substantially planar bottom edge parallel to the lower edge means and spaced apart from the lower edge means by a predetermined distance. This defines an elongate gap having a gap width controlled by the spacing between the bottom edge and the lower edge means. Several vent openings are formed through the shell, open to the first compartment. The vacuum source draws air through the vents into the first compartment to mingle with the atomized liquid cleaning solution, whereby the fluid drawn into the second compartment is a mixture of air and atomized liquid. The size and number of vent openings are selected with reference to the gap to insure that the gap is the controlling or critical orifice governing fluid flow. The partition can have a convex surface immediately adjacent the bottom edge in the downstream direction to promote and control diffusion of the fluid stream.

The shell preferably includes a glide with a glide surface forming part of the lower edge means and having a surface area at least equal to the chamber area bound by the lower edge means. Due to this relatively large surface area, the glide resists the tendency of the vacuum force to pull the shell downward into certain yielding surfaces, for example plush carpeting. The glide and pivotally mounted support arms cooperate to maintain the desired position and orientation of the shell with respect to the floor. This position and orientation depend on the glide surface area, the position of the support arm pivot and the tendency of the flooring or other surface to yield, and thus are not subject to the operator's degree of skill and attention. The desired vacuum action and critical gap width are maintained.

It is to be appreciated that the present invention, while perhaps most advantageously applied to a continuous flow recycling system, is also advantageous in connection with other systems employing liquids and vacuum action in combination, and in dry-vacuum systems in which a movable yet position/orientation controlled cleaning tool is desired.

IN THE DRAWINGS

For a further understanding of the above and other features and advantages, reference is made to the following detailed description and to the drawings in which.

BRIEF DESCRIPTION OF THE PREFERRED EMBODIMENT

Figure 1:
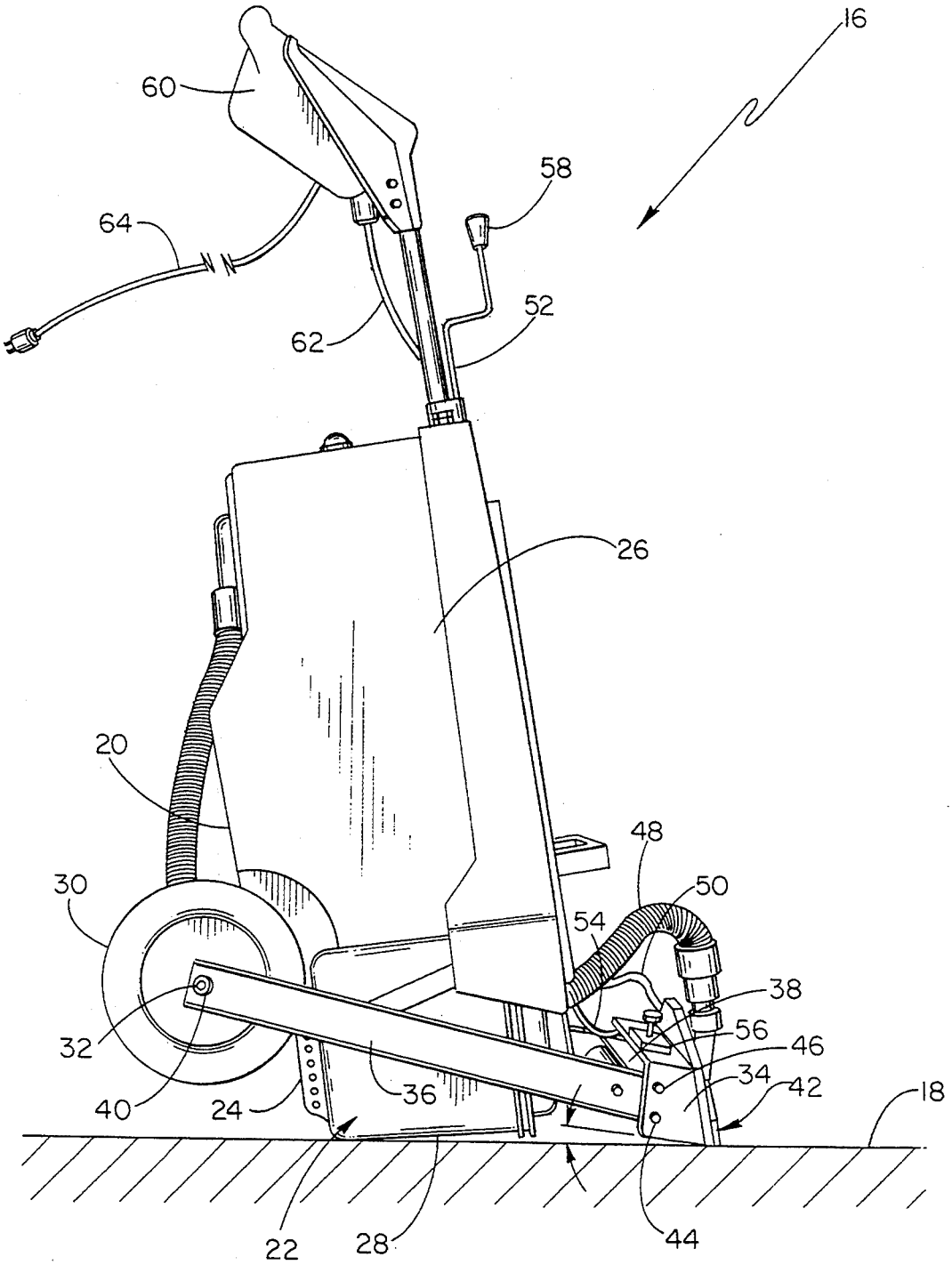
FIG. 1 is a side elevation of a portable cleaning device constructed according to the invention shown, in an upright storage position with a cleaning head of a device latched into a raised position.

Turning now to the drawings, there is shown in FIG. 1 a portable, vacuum-operated continuous flow recycling device 16 for cleaning planar surfaces, such as a floor shown at 18. The device is compact, having a housing 20 with a lower housing section 22 for containing a vacuum motor and blower. At one end of the lower housing section is a muffler 24. An upper housing section 26 of the housing includes a reservoir or tank for a liquid cleaning solution. In a separate compartment, the upper housing section contains a liquid pump for circulating the solution in a manner later explained.

In this figure, device 16 is shown in a storage position, supported by lower housing section 22. A bottom surface 28 of the lower housing section is planar and, because of its large surface area, permits storage of the device without undue matting or other damage to the floor. A pair of wheels, one of which is shown at 30, support housing 20 for movement over the floor when device 16 is not in the storage position. A wheel axle 32 defines a wheel axis about which the wheels rotate.

Device 16 is self-contained in the sense that a cleaning head 34 is not freely movable independently of the housing. Rather, a pair of head support arms 36 and 38 are mounted to pivot relative to the housing and define an arcuate path for the cleaning head assembly. Support arm 36, for example, is mounted to rotate through a bushing 40. The opposite end of the arm 36 is fixed to a shell 42 of the cleaning head by a pair of fasteners 44 and 46 that prevent the shell from pivoting relative to the arms. In similar fashion, support arm 38 is connected to the axle and the shell. Thus, arms 36 and 38, by their angular position, control the orientation of shell 42.

A pliable vacuum hose 48 is connected between the vacuum motor and shell 42, for drawing a vacuum within the shell during operation. A pliable length of tubing 50 conducts the liquid cleaning solution from the reservoir to the shell. Hose 48 and tubing 50 are of sufficient length to accommodate the arcuate travel of the cleaning head assembly.

As seen in this figure, placing device 16 in the upright storage position positions wheel 30 (and its counterpart) above floor 18. Likewise, support arms 36/38 and shell 42 are off the floor, held by a latching mechanism including a central upright rod 52, a bent end portion 54 positioned to engage and hold a lip 56 integral with shell 42, and an operator control knob 58.

At the top of device 16 is a handle 60, from which the operator controls and manipulates the device. A conductive line 62 provides electrical current to the vacuum motor/blower and the motor that controls the liquid pump. A further electrical line 64 conducts current to device 16 from an electrical outlet.

Figure 2:
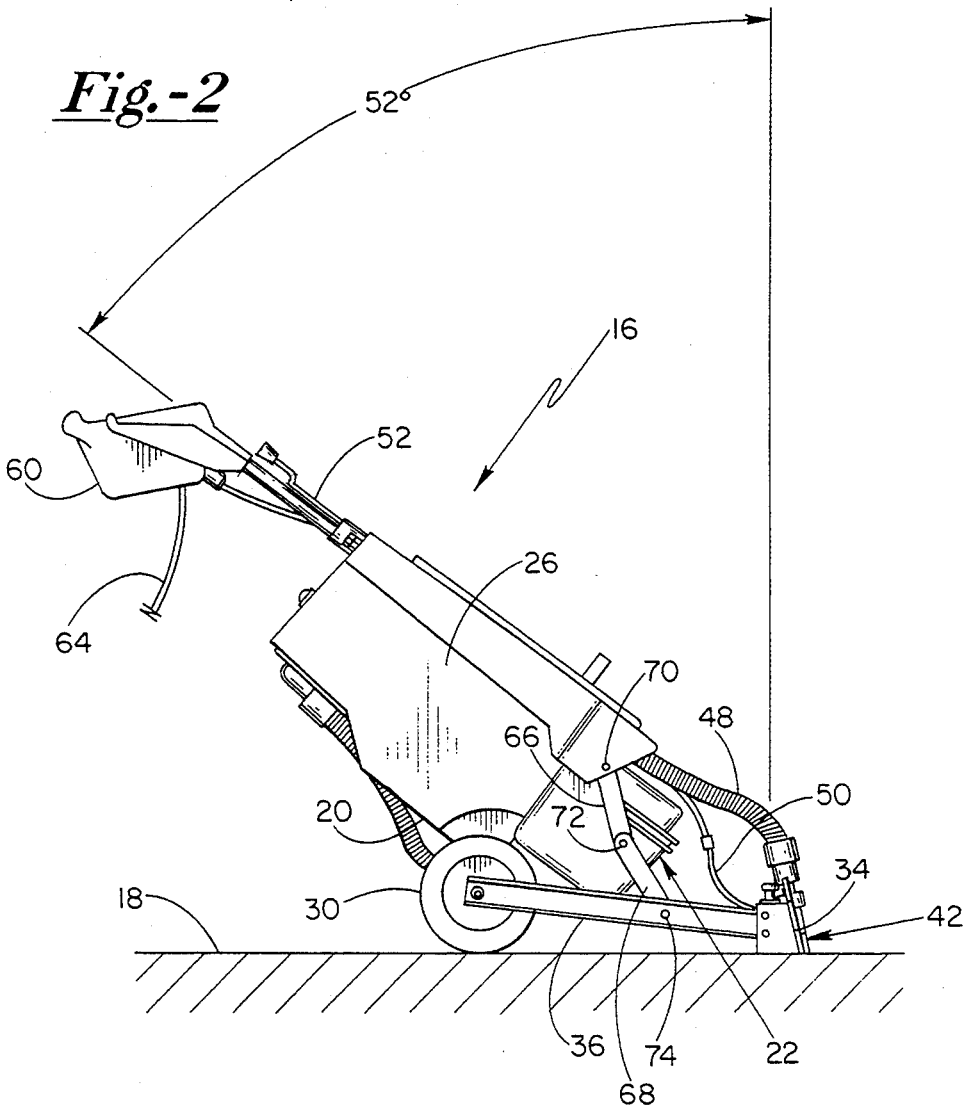
FIG. 2 is a side elevation showing the device in an operating position.

In FIG. 2, device 16 is shown in an operating position, in which housing 20 is tilted backwardly approximately fifty degrees from a vertical orientation. In this position, the wheels are below the housing, including lower housing section 22, and thus support the device. The latching mechanism is rotated to release the cleaning head from the raised position, and the head is moved into contact with floor 18. The position and orientation of shell 42 are closely controlled, respectively, by contact of the shell with the floor and the angular position of the support arms. Moreover, position and orientation are maintained over a range of housing tilt angles, corresponding to differences among operators as to physical height and preferred handle position. Further, the same individual may alter the handle position from time to time during operation, for increased comfort or to avoid fatigue. Such on-the-fly adjustments, as well, are accommodated by the support arms.

More particularly, cleaning head orientation remains constant because the height and angular position of support arms 36 and 38 remain constant despite forward and rearward tilting of the housing over the permitted operational range. This result is achieved by pivotally mounting support arms 36 and 38 on wheel axle 32. Thus the wheel axis about which the housing is rotated, and the pivot axis about which the cleaning head travels, coincide.

FIG. 2 further shows a pair of links 66 and 68, connected between housing 20 and support arm 36 by three pivots 70, 72 and 74. In the operating position, links 66 and 68 form an obtuse angle less than 180 degrees, as shown. A similar pair of links (not shown) connect arm 38 to the other side of housing 20. A chain or cable also would serve as a suitable stop means in lieu of the links.

Figure 3:
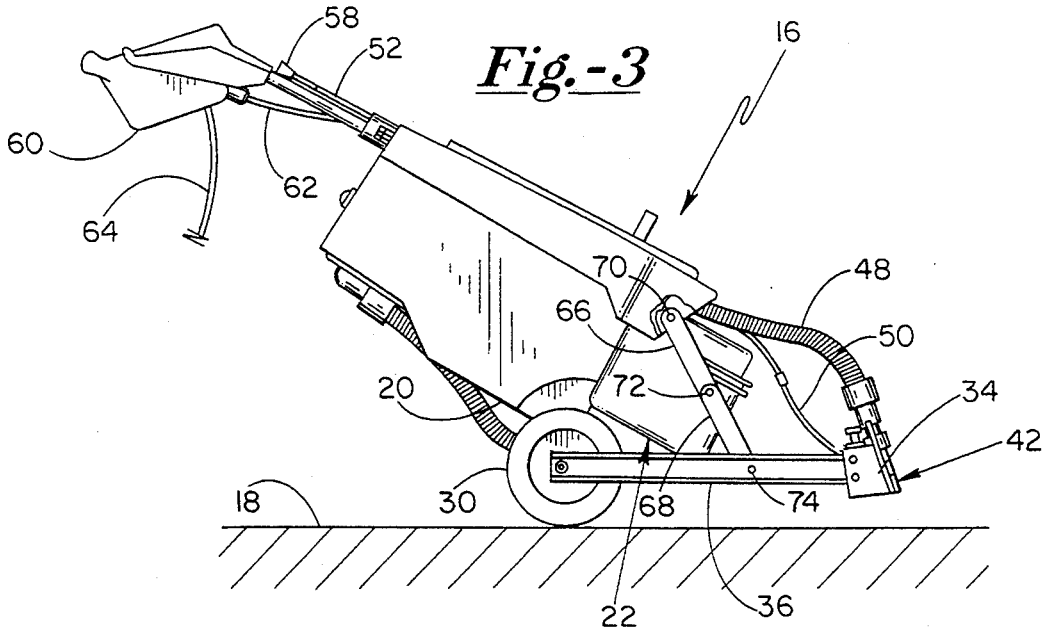
FIG. 3 is a side elevation in which the device is tilted backwardly to place the cleaning head in a suspended position.

FIG. 3 illustrates a further backward tilting of cleaning device 16 into a suspended position for convenient, short-term transport of the device. Links 66 and 68 form an essentially straight line, and thus prevent any further pivoting of support arms 36 and 38 in the clockwise direction as viewed in FIG. 3. The length of links 66 and 68 determines the suspended position of the shell and support arms, which is selected to be beyond the lowest head and arm position expected under a normal operating range.

Figure 4:
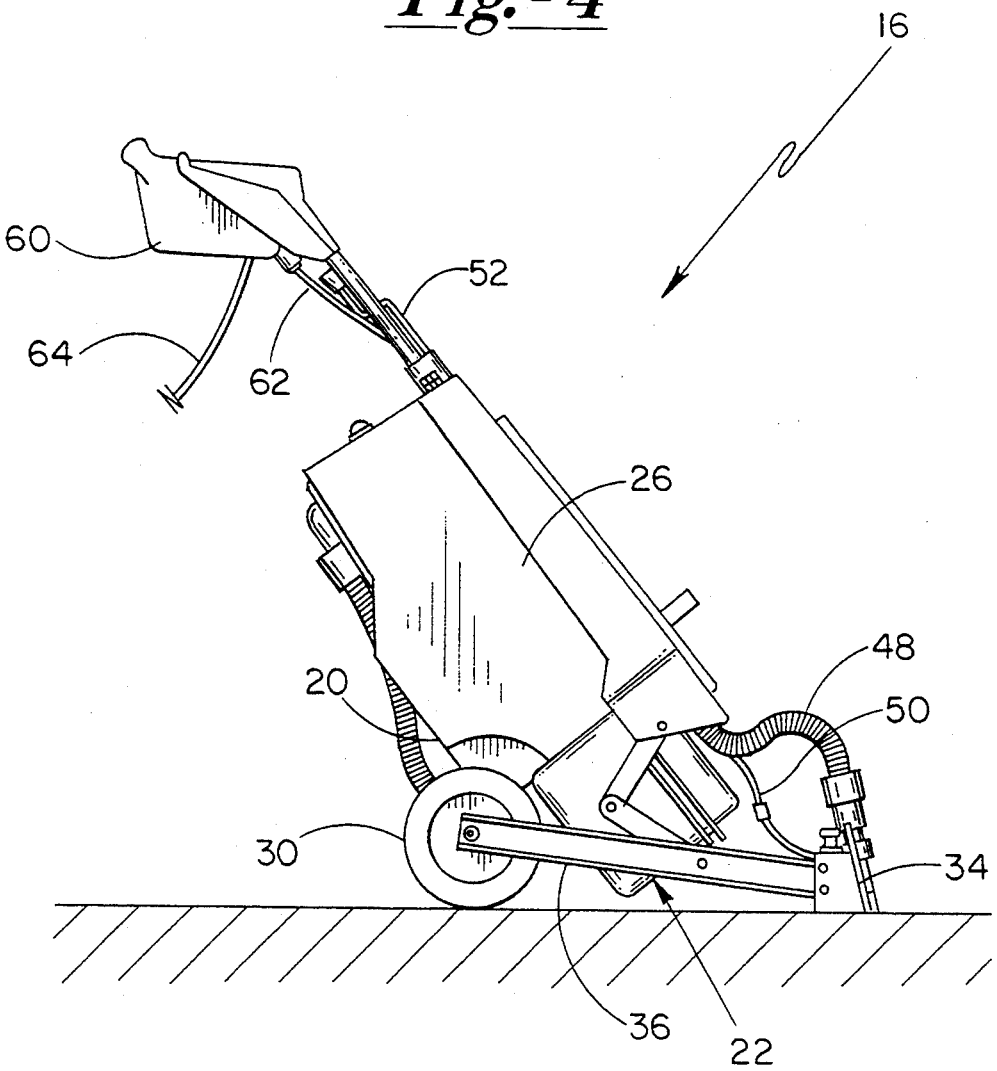
FIG. 4 is a partial view of the device illustrating an at-rest position.

FIG. 4 illustrates a temporary at-rest or unattended position for device 16, in which the device weight is supported primarily by the wheels and by lower housing section 22. The cleaning head shell is unlatched, its position determined by contact with floor 18. The mounting of the vacuum motor/blower in the lower housing section and the positioning of the liquid pump toward the forward end of upper housing section 26 tend to locate the device center of mass close to floor 18 and forwardly of the wheels, even when the reservoir is filled with cleaning liquid. Thus, device 16 can be left in the position illustrated without any tendency of the machine to rock backwardly from the degree of tilt illustrated, which is approximately 30 degrees from vertical.

Figure 5:
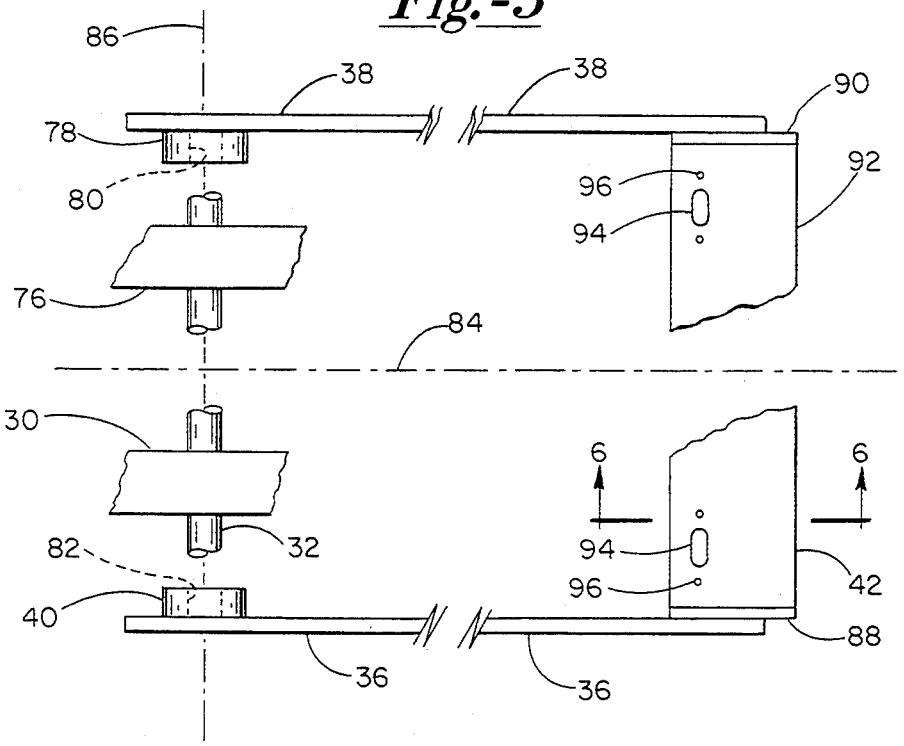
FIG. 5 is an enlarged partial top view illustrating the pivotal coupling of the cleaning head support arms.

FIG. 5 illustrates the cleaning head assembly mounting in greater detail. Axle 32 supports wheel 30 and a wheel 76 on the opposite side of the housing. Support arm 38 is pivotally mounted onto axle 32 by a bushing 78 which has an opening 80 to accommodate the axle. The interior diameter of the bushing opening is slightly greater than the axle outside diameter, e.g. about 0.51 inches as opposed to an axle O.D. of 0.50 inches. Bushing 40 mounting support arm 36 is similarly provided with an internal opening 82 larger than the axle. This mounting permits an additional degree of freedom, to enable limited tilting of cleaning head shell 42 about a roll axis 84, along with the permitted rotation about pivot axis 86. This additional degree of freedom may also be accomplished by flexibility in support arms 36 and 38. Roll axis 84 is perpendicular to the pivot axis and parallel to floor 18.

Support arms 36 and 38 are fixed respectively to opposite end plates 88 and 90 of the cleaning head shell. The end plates, in turn, are mounted to an elongate shell section 92 including forward, top and rearward walls. A plurality of openings are formed along the top wall, including relatively large nozzle openings 94 to accommodate liquid spray nozzles, and substantially smaller vent openings 96 to permit air to enter the space beneath shell 42.

Figure 6:
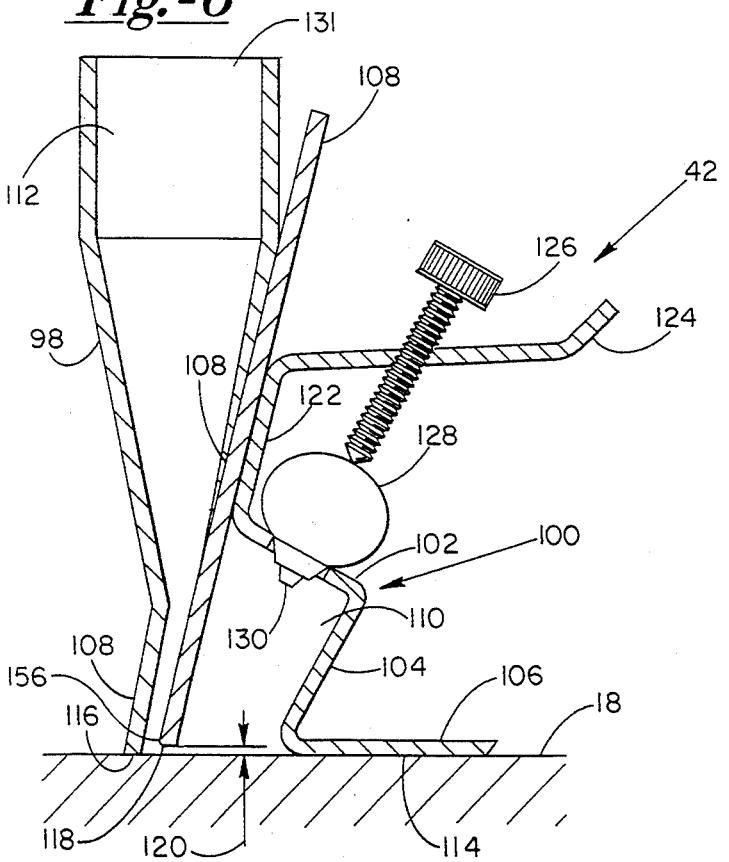
FIG. 6 is a sectional view taken along the line 6—6 in FIG. 5.
Figure 6A:
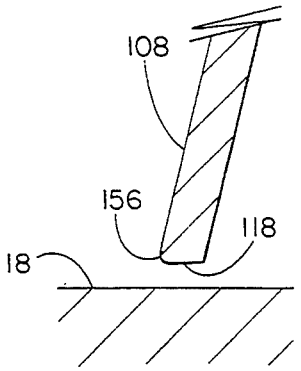

From FIG. 6 it is apparent that shell 42, when in the operating position, cooperates with floor 18 to form a substantially enclosed chamber. Parts of the shell which define and shape the chamber include a forward wall 98, a shoe 100 selectively shaped to provide a nozzle mounting section 102, a rear wall 104 and a horizontal glide 106. A partition 108 divides the chamber into two compartments, an intake compartment 110 for receiving a liquid spray and air, and a vacuum compartment 112 for drawing a vacuum through the entire chamber. Also defining the chamber are end plates 88 and 90 (FIG. 5).

The lower edge of forward wall 98, lower edges of end plates 88 and 90, and a lower surface 114 of glide 106, all cooperate to provide a substantially continuous and planar lower edge means or portion 116 of shell 42. The lower edge portion remains in surface engagement with floor 18 to determine the operating position of the cleaning head. A lower edge 118 of partition 108 is parallel to the shell lower edge (i.e. horizontal), but spaced apart from the shell edge by a predetermined distance to form a gap 120 between the floor and partition. Partition 108 spans the entire length of shell 42. In one preferred embodiment, gap 120 is approximately 0.030 inches wide, and the partition and shell are approximately 12 inches long.

Shoe 100 further includes a bonding segment 122 mounted to partition 108 and a top section 124. An opening in top section 124 accommodates a thumb screw 126. The thumb screw is adjustable to accommodate and secure an elongate, cylindrical spray bar 128 between mounting section 102 and top section 124. Protruding from spray bar 128 are several nozzles, one of which is shown at 130. Nozzle 130 extends into intake compartment 110 through its associated one of nozzle openings 94. The location of the nozzle openings, shoe and thumb screw determine the desired orientation of the spray bar to properly aim the spray of atomized liquid cleaning solution. Preferably, the spray is fan-shaped, diverging in the length direction of the shell but remaining thin in the opposite direction so as to appear essentially linear in FIG. 6. As shown, the desired target location for the spray is just behind partition 108.

Near the bottom of shell 42, the opening into vacuum compartment 112 is rectangular. Forward wall 98 is selectively shaped to provide a smooth transition from a rectangular profile near gap 120 to a circular exit 131 at the top of the shell. The vacuum compartment is formed to have a smooth, constant cross-sectional area transition from a rectangular entry profile to circular exit 131, to minimize energy losses by maintaining velocity substantially constant through the compartment. Hose 48 (FIGS. 1–3) is coupled to exit 131, for transporting fluid (mixture of air and atomized cleaning liquid) out of compartment 112, and into a fluid reservoir via an upright tubing section and filter as explained below.

Figure 7:
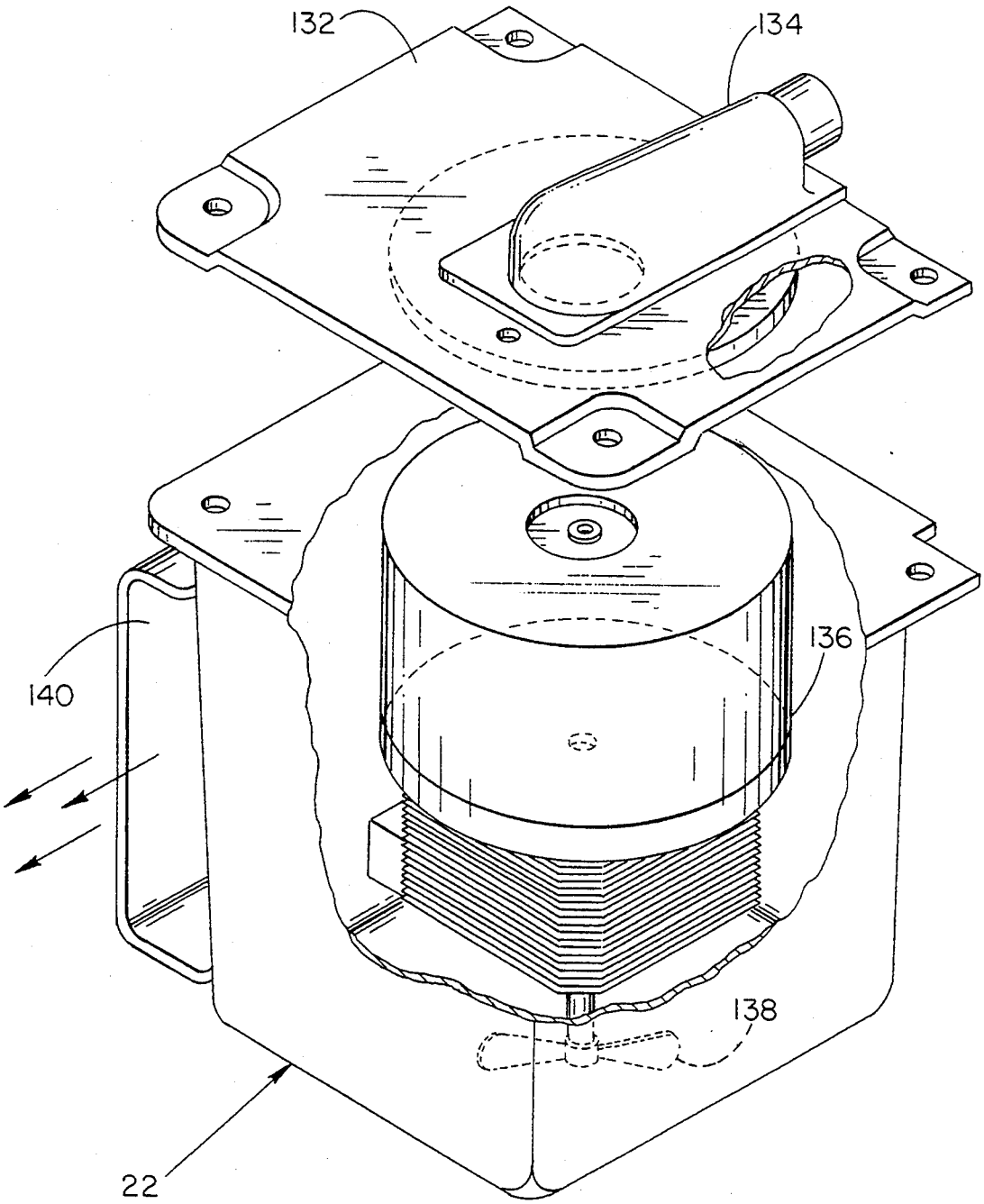
FIG. 7 is a perspective view of a housing of the device and a vacuum motor/blower contained in the housing.

FIG. 7 is an exploded parts view of lower housing section 22. Housing section 22 includes a top cover portion 132 including a suction chamber 134 for receiving air and atomized cleaning solution from hose 48. A vacuum motor 136 and blower 138 are mounted inside housing section 22. The motor provides the vacuum source for drawing air into and through suction chamber 134, then expels the air and atomized liquid through a discharge diffuser 140. Cooling air for motor 138 is discharged from housing section 22 through slots on cover 132 and through discharge diffuser 140. An outlet hole between housing 22 and discharge diffuser 140 is chamfered to provide a narrow gap between the end of the lower discharge tube and the outlet hole. Because of the chamfer and gap, additional motor cooling air is drawn into the discharge diffuser.

Figure 8:
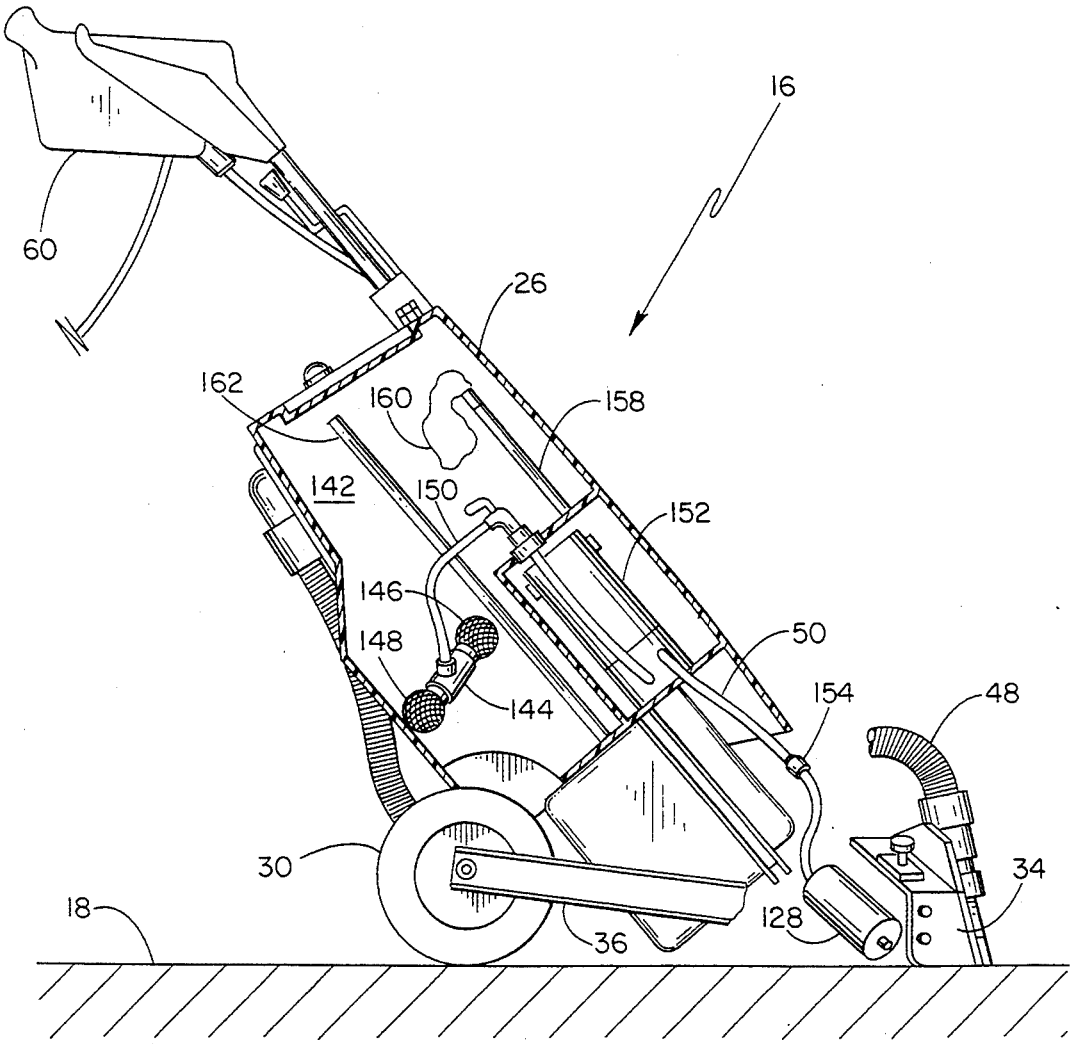
FIG. 8 is a side elevation, partially in section, illustrating a liquid reservoir and liquid supply path.

Turning to FIG. 8, it is seen that the majority of upper housing section 26 is occupied by a reservoir or tank 142 containing the liquid cleaning solution. A T-connection 144 having two filtered inlets 146 and 148 receives the cleaning solution for transport through a flexible conduit 150 by a liquid pump 152. Pump 152 expels the liquid through tubing 50 and a strainer 154 to spray bar 128 and into compartment 110 via the nozzles.

Simultaneously, vacuum motor 136 is operated to draw a vacuum, in particular by drawing air out of vacuum compartment 112. This creates a partial vacuum within intake compartment 110 (FIG. 6) causing air to enter the compartment through vent openings 96. Thus, a mixture of air and atomized cleaning solution is drawn downwardly and forwardly toward gap 120 and floor 18.

For hard (e.g. ceramic) floors, floor 18 and lower edge 118 precisely define the width of gap 120. A carpeted floor likewise cooperates with the partition to define the gap width, although the carpet pile permits at least a portion of the air and atomized solution to penetrate beneath the upper surface of the carpet. In either event, the vacuum draws virtually all of the air and solution upwardly back into the chamber, more precisely into vacuum compartment 112.

Cleaning is most efficient if the fluid flow experiences maximum energy transfer at gap 120. To this end, the combined capacity (cross-sectional area perpendicular to direction of flow) of vent openings 96 is carefully selected with reference to the size of gap 120, to insure that the gap is the controlling or critical orifice along the fluid flow path. In other words, the fluid handling capacity of a gap is less than the capacity of the vent openings, in combination with any air entering compartment 110 beneath the shell edges, which is more likely to occur when floor 18 is carpeted.

Carpeted floors also raise a concern as to maintaining the size of gap 120, due to their yielding nature and the tendency of the vacuum to force shell 42 downwardly into the carpet, thus to narrow the gap and interfere with head movement over the floor.

To overcome this tendency, glide 106 presents a large, horizontal surface area, at least equal to the surface area of floor 18 within the chamber. With the downward vacuum force distributed over a large area, a carpeted or other yielding floor is better able to withstand and resist the force, to accurately maintain the gap width. Support arms 36 and 38, in maintaining a consistent shell orientation, cooperate with glide 106 in maintaining the gap width and in preserving overall stability. In this connection, it should be appreciated that the length of arms 36 and 38 is much greater than the width dimension of shell 42, preferably by a factor of at least five. As a result, any irregularities in floor 18 sufficient to vertically displace shell 42 also rotate a shell, but by a very slight amount, since rotation is about pivot axis 86. In practice, it has been found advantageous to employ a support arm length of approximately twenty inches, in combination with a shell width of about 2½ inches.

Another factor in insuring efficiency is to properly diffuse the fluid flow, to the extent possible, immediately downstream of partition 118. To this end, the forward edge of the partition near lower edge 116 is formed with a radius to provide a rounded surface 156. The preferred radius is 0.030 inches.

The air and atomized liquid are drawn upwardly out of vacuum compartment 112 through hose 48, then through a rigid tubing section 158 and into reservoir 142 (FIG. 8). A bag-like filter 160 permits air to enter the upper housing section, while filtering the cleaning solution by collecting the atomized solution and allowing it to enter the reservoir. Vacuum motor 136 draws air out of reservoir 142 through an upright standpipe 162 into suction chamber 134 and then out of housing section 22 via discharge diffuser 140.

Thus, in accordance with the preferred embodiment of the invention, there is provided a compact, self-contained continuous flow recycling system particularly well suited for cleaning carpeted floors and other planar surfaces. If desired, upholstery wall fabric and the like can be cleaned using suitable attachment tools in lieu of cleaning head 34, by a simple transfer of the vacuum and liquid connections. While this invention has been explained in connection with a continuous flow recycling system, it is to be appreciated that the disclosed principles can be employed in a non-recycling vacuum/liquid solution environment, and in dry vacuum applications as well.

What is claimed is:

1. A portable vacuum cleaning apparatus including:

a housing;

a wheel means mounted to the housing for rotation on a wheel axis, for supporting the housing for movement over a substantially planar surface;

a vacuum head including a shell having a substantially planar lower edge means for engaging said surface to determine an operating position of the vacuum head, in which the shell and the surface cooperate to define a substantially enclosed chamber;

a substantially rigid head support means mounted to pivot relative to the housing to support the head for movement along an arcuate path relative to the housing, said arcuate path including said operating position in which the lower edge means engages the surface, and a retracted position in which the head is positioned above and spaced apart from the surface, said shell being fixed to the head support means in a predetermined orientation to insure substantial coplanarity of the lower edge means and the surface when the head assembly is in said operating position; and a vacuum means for drawing a partial vacuum within the chamber when the head assembly is in the operating position, the vacuum means including a vacuum source in said housing and a conduit means extending from the head to the housing, in fluid communication with the vacuum source and in fluid communication with the chamber, said conduit means being pliable to accommodate the arcuate travel of the head assembly.

2. The cleaning apparatus of claim 1 wherein:

the head support means pivots on a pivot axis parallel to the wheel axis.

3. The cleaning apparatus of claim 2 wherein:

said pivot axis and the wheel axis substantially coincide.

4. The apparatus of claim 3 wherein:

said support means includes two support arms on opposite sides of the housing, each arm including a first end pivotally mounted with respect to the housing and a second end fixed to the shell.

5. The cleaning apparatus of claim 4 wherein:

said shell is elongate in the direction parallel to the wheel axis and has a width dimension parallel to said surface when in the operating position, and wherein a length dimension of each support arm is at least five times the width dimension of the shell.

6. The cleaning apparatus of claim 4 wherein:

the support means further includes a bushing integral with each support arm and mounted for rotation relative to an axle of the wheel means, and wherein an outer diameter of the axle is slightly less than an inner diameter of the bushings.

7. The cleaning apparatus of claim 4 wherein:

said support arms are substantially rigid but sufficiently flexible to permit limited rotation of the vacuum head, relative to the housing, about a roll axis substantially perpendicular to the wheel axis.

8. The cleaning apparatus of claim 4 further including:

a stop means for limiting said arcuate movement in the direction away from the retracted position, to support the shell and the support arms in a predetermined position relative to the housing, the operating position being between the retracted position and the predetermined position.

9. The cleaning apparatus of claim 8 wherein:

said stop means comprises a pair of elongate links pivotally connected between the housing and at least one of the head support arms.

10. The cleaning apparatus of claim 3 further including:

a glide integral with the shell and having a glide surface forming part of the lower edge means, the glide surface having a surface area at least equal to an area of the chamber bound by the lower edge means.

11. The cleaning apparatus of claim 1 further including:

a latching means for maintaining the head in the raised position.

12. The cleaning apparatus of claim 11 wherein:

said housing has a substantially planar bottom surface, and wherein the head when in the retracted position is above the bottom surface.

13. The cleaning apparatus of claim 1 wherein:

the shell of the head includes a forward wall, a rearward wall and a partition between the forward and rearward walls to divide the chamber into a first compartment and a second compartment, and wherein the conduit means is open to the second compartment for drawing fluid from the first compartment to the second compartment.

14. The cleaning apparatus of claim 13 wherein:

said partition has a substantially planar lower edge, parallel to the lower edge means and spaced apart from the lower edge means by a predetermined distance in a direction normal to the plane of the lower edge means, to define an elongate gap having a predetermined gap width equal to said predetermined distance when the head assembly is in the operating position.

15. The cleaning apparatus of claim 14 further including:

a liquid supply means for providing a liquid spray into the first compartment.

16. The cleaning apparatus of claim 15 further including:

a plurality of vent openings through the shell and into the first compartment, cooperating with the liquid supply means to provide a mixture of air and liquid in the first compartment.

17. The cleaning apparatus of claim 16 wherein:

the vent openings have a predetermined combined maximum size with respect to said gap, to insure that the gap is the critical orifice controlling the volume of liquid and air drawn through the first compartment and second compartment by the vacuum source.

18. The cleaning apparatus of claim 15 wherein:

said partition further includes a convex surface immediately downstream of said bottom surface and spanning the length of said gap.

19. The cleaning apparatus of claim 14 wherein:

said shell is formed to provide the second compartment with a substantially rectangular entry and a substantially circular exit, and further with a smooth, constant cross-sectional area transition from the entry to the exit.

20. The cleaning apparatus of claim 1 wherein:

said vacuum means includes a discharge diffuser, a vacuum blower housing having a housing outlet between the blower housing and the discharge diffuser, and a gap near the housing outlet through which vacuum motor cooling air is drawn from the blower housing into the discharge diffuser.

* * * * *